US006357257B1

(12) United States Patent
Goble, Jr. et al.

(10) Patent No.: US 6,357,257 B1
(45) Date of Patent: Mar. 19, 2002

(54) CRYOGENIC INDUSTRIAL GAS LIQUEFACTION WITH AZEOTROPIC FLUID FORECOOLING

(75) Inventors: Vance Goble, Jr., Oakmont, PA (US); Arun Acharya, East Amherst; Bayram Arman, Grand Island, both of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/768,505

(22) Filed: Jan. 25, 2001

(51) Int. Cl.[7] ..... F25J 1/00

(52) U.S. Cl. ..... 62/613
(58) Field of Search ..... 62/613, 619

(56) References Cited

U.S. PATENT DOCUMENTS

| | | | | | |
|---|---|---|---|---|---|
| 3,373,574 | A | * | 3/1968 | Fisher | 62/619 |
| 5,729,993 | A | | 3/1998 | Boiarski et al. | 62/175 |
| 6,053,008 | A | | 4/2000 | Arman et al. | 62/646 |
| 6,065,305 | A | | 5/2000 | Arman et al. | 62/613 |
| 6,076,372 | A | | 6/2000 | Acharya et al. | 62/606 |
| 6,105,388 | A | | 8/2000 | Acharya et al. | 62/612 |

* cited by examiner

*Primary Examiner*—Ronald Capossela
(74) *Attorney, Agent, or Firm*—Stanley Ktorides

(57) ABSTRACT

An industrial gas liquefaction cycle employing a main refrigeration circuit to supply low level refrigeration to the industrial gas, and a forecooling circuit employing an azeotropic mixture to provide high level refrigeration to the refrigerant fluid recirculating within the main refrigeration circuit.

10 Claims, 2 Drawing Sheets

CRYOGENIC INDUSTRIAL GAS LIQUEFACTION WITH AZEOTROPIC FLUID FORECOOLING

TECHNICAL FIELD

This invention relates generally to the liquefaction of industrial gas and, more particularly, to the liquefaction of industrial gas using a multiple circuit liquefier.

BACKGROUND ART

The liquefaction of industrial gas is a power intensive operation. Typically the industrial gas is liquefied by indirect heat exchange with a refrigerant. Such a system, while working well for providing refrigeration over a relatively small temperature range from ambient, is not as efficient when refrigeration over a large temperature range, such as from ambient to a cryogenic temperature, is required. This inefficiency may be addressed by using more than one refrigeration circuit to get the requisite cryogenic condensing temperature. However, such systems require a significant power input in order to achieve the desired results and/or require complicated and costly heat exchanger designs and phase separators in the circuit.

Accordingly, it is an object of this invention to provide a multiple circuit arrangement whereby industrial gas may be brought from ambient temperature to a colder temperature, especially to a cryogenic liquefaction temperature, which is less complicated than heretofore available multiple circuit systems while operating with a relatively low power input requirement.

SUMMARY OF THE INVENTION

The above and other objects, which will become apparent to those skilled in the art upon a reading of this disclosure, are attained by the present invention, one aspect of which is:

A method for cooling industrial gas comprising:

(A) compressing a gaseous azeotropic mixture, and condensing the compressed azeotropic mixture;

(B) expanding a first portion of the condensed azeotropic mixture to generate refrigeration, and vaporizing the refrigeration bearing azeotropic mixture first portion by indirect heat exchange with the compressed azeotropic mixture to effect the said condensation of the compressed azeotropic mixture;

(C) subcooling a second portion of the condensed azeotropic mixture and expanding the subcooled azeotropic mixture second portion to generate high level refrigeration;

(D) vaporizing the high level refrigeration bearing azeotropic mixture second portion by indirect heat exchange with compressed refrigerant fluid to provide cooled, compressed refrigerant fluid;

(E) expanding the cooled compressed refrigerant fluid to generate low level refrigeration; and (F) warming the low level refrigeration bearing refrigerant fluid by indirect heat exchange with industrial gas to cool the industrial gas.

Another aspect of the invention is:

A method for cooling industrial gas comprising:

(A) compressing a gaseous azeotropic mixture, condensing the compressed azeotropic mixture, and expanding the compressed condensed azeotropic mixture to generate high level refrigeration;

(B) vaporizing the high level refrigeration bearing azeotropic mixture by indirect heat exchange with compressed refrigerant fluid to provide cooled compressed refrigerant fluid;

(C) expanding the cooled compressed refrigerant fluid to generate low level refrigeration; and (D) warming the low level refrigeration bearing refrigerant fluid by indirect heat exchange with industrial gas to cool the industrial gas.

As used herein, the term "expansion" means to effect a reduction in pressure.

As used herein, the term "industrial gas" means nitrogen, oxygen, argon, hydrogen, helium, carbon dioxide, carbon monoxide, krypton, xenon, neon, methane and other hydrocarbons having up to 4 carbon atoms, and fluid mixtures comprising one or more thereof.

As used herein, the term "cryogenic temperature" means a temperature of 150° K or less.

As used herein, the term "refrigeration" means the capability to reject heat from a subambient temperature system to the surrounding atmosphere.

As used herein, the term "high level refrigeration" means the temperature of refrigeration for the precooler loop is less than 260 K.

As used herein, the term "low level refrigeration" means the temperature of the refrigeration for the main loop is less than 240 K.

As used herein, the term "subcooling" means cooling a liquid to be at a temperature lower than that liquid's saturation temperature for the existing pressure.

As used herein, the term "warming" means increasing the temperature of a fluid and/or at least partially vaporizing the fluid.

As used herein, the term "cooling" means decreasing the temperature of a fluid and/or at least partially condensing the fluid.

As used herein, the term "indirect heat exchange" means the bringing of two fluids into heat exchange relation without any physical contact or intermixing of the fluids with each other.

As used herein, the term "expansion device" means apparatus for effecting expansion of a fluid.

As used herein, the term "compressor" means apparatus for effecting compression of a fluid.

As used herein, the term "multicomponent refrigerant fluid" means a fluid comprising two or more species and capable of generating refrigeration.

As used herein, the term "refrigerant fluid" means a pure component or mixture used as a working fluid in a refrigeration process which undergoes changes in temperature, pressure and possibly phase to absorb heat at a lower temperature and reject it at a higher temperature.

As used herein, the term "variable load refrigerant" means a mixture of two or more components in proportions such that the liquid phase of those components undergoes a continuous and increasing temperature change between the bubble point and the dew point of the mixture. The bubble point of the mixture is the temperature, at a given pressure, wherein the mixture is all in the liquid phase but addition of heat will initiate formation of a vapor phase in equilibrium with the liquid phase. The dew point of the mixture is the temperature, at a given pressure, wherein the mixture is all in the vapor phase but extraction of heat will initiate formation of a liquid phase in equilibrium with the vapor phase. Hence, the temperature region between the bubble point and the dew point of the mixture is the region wherein both liquid and vapor phases coexist in equilibrium. In the preferred practice of this invention the temperature differences between the bubble point and the dew point for a variable load refrigerant generally is at least 10° C., preferably at least 20° C., and most preferably at least 50° C.

As used herein, the term "azeotropic mixture" means a mixture of two or more components which act as a single component so that the mixture is totally condensed or totally vaporized at a single temperature, and as the mixture undergoes condensation or vaporization, the concentration of the components in the liquid phase is and remains the same as the concentration of the components in the vapor phase.

DETAILED DESCRIPTION

Figure 1:
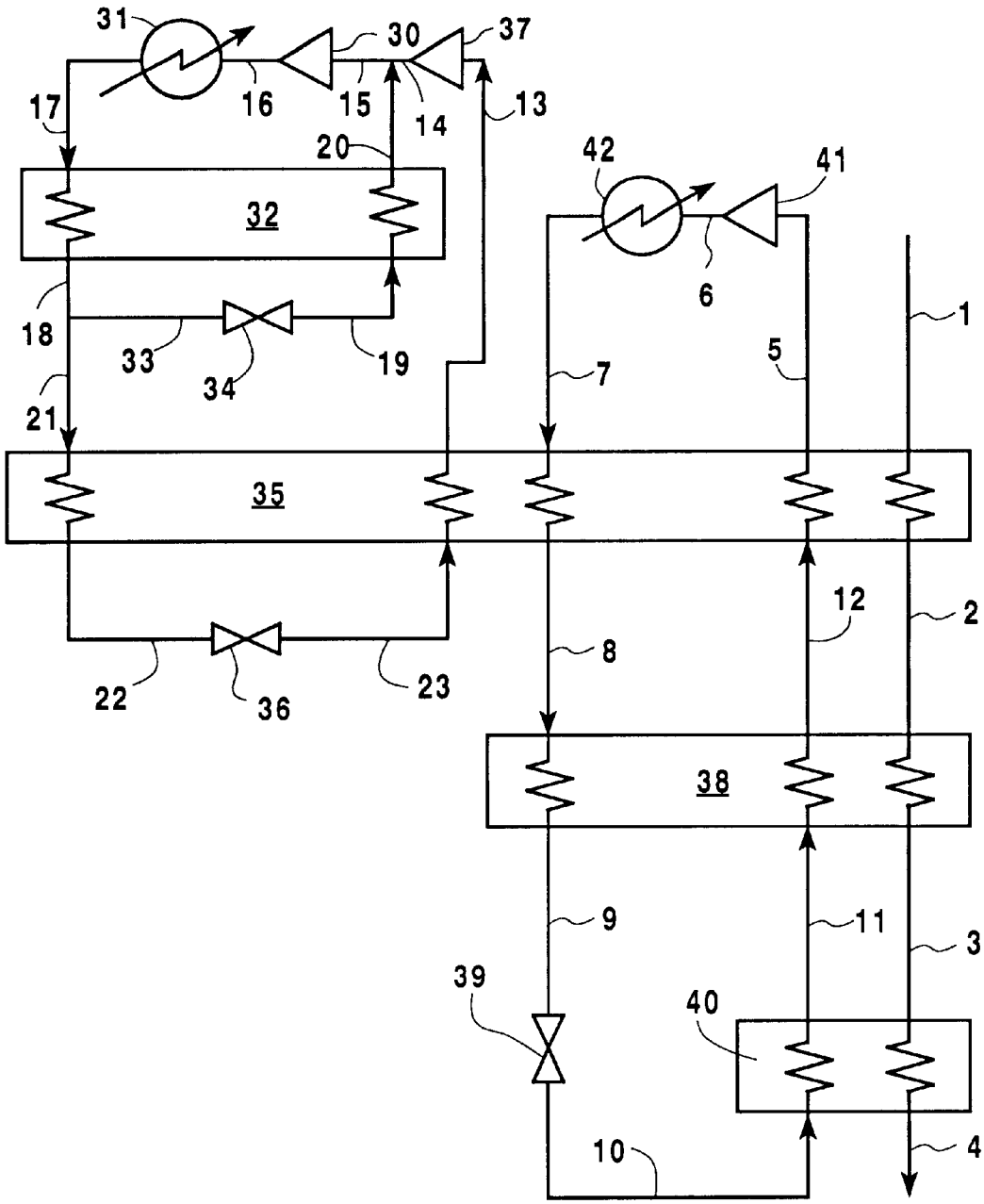
FIG. 1 is a schematic representation of one preferred arrangement wherein the industrial gas liquefaction method of this invention may be practiced.

The invention will be described in detail with reference to the Drawings. Referring now to FIG. 1, gaseous azeotropic mixture 15 is compressed by passage through compressor 30 to a pressure generally within the range of from 50 to 500 pounds per square inch absolute (psia). Generally the azeotropic mixture used in the practice of this invention will be comprised of two components but may contain up to 6 components. Preferably the azeotropic mixture useful in the practice of this invention comprises two or more of the following components: tetrafluoroethane (R-134a), difluoromethane (R-32), propane (R-290), trifluoroethane (R-143a), pentafluoroethane (R-125), fluoroform (R-23), perfluoroethane (R-116), carbon dioxide (R-744), perfluoropropoxy-methane (R-347E), dichlorotrifluoroethane (R-123), perfluoropentane (R-4112), methanol, and ethanol. Examples of binary mixtures include R-134a with R-290, R-32 with R-143a, R-125 or R-290, R-125 with R-143a or R-290, R-23 and R-116 or R-744, R-116 with R-744, and R-347E with R-123, R-4112, methanol or ethanol. An example of a ternary mixture is R-32 with R-125 and R-134a.

Compressed gaseous azeotropic mixture 16 is cooled of the heat of compression in cooler 31 and resulting cooled gaseous azeotropic mixture 17 is provided to heat exchanger 32 wherein it is condensed by indirect heat exchange with vaporizing azeotropic fluid as will be further described below.

Condensed azeotropic mixture 18 from heat exchanger 32 is divided into a first portion 33 and a second portion 21. First portion 33 is expanded to generate refrigeration. In the embodiment of the invention illustrated in FIG. 1 the expansion device 34 through which first portion 33 is expanded is a Joule-Thomson expansion value. Refrigeration bearing azeotropic mixture first portion 19 is vaporized by passage through heat exchanger 32 to effect the condensation of stream 17 as was previously described, and resulting vaporized azeotropic mixture first portion 20 is combined with stream 14 to form stream 15 for input into compressor 31.

The second portion 21 of the condensed azeotropic mixture is subcooled by passage through heat exchanger 35 by indirect heat exchange with vaporizing azeotropic mixture second portion as will be further described below. Resulting subcooled azeotropic mixture second portion 22 is expanded by passage through Joule-Thomson valve 36 to generate high level refrigeration. The high level refrigeration bearing azeotropic mixture second portion 23 is vaporized in heat exchanger 35 to effect the aforesaid subcooling of stream 21 and also to cool recirculating refrigerant fluid in the main refrigeration loop as will be further described below. Resulting vaporized azeotropic mixture second portion 13 is passed from heat exchanger 35 to compressor 37 wherein it is compressed to a pressure generally within the range of from 25 to 200 psia. Resulting azeotropic mixture second portion 14 from compressor 37 is combined with azeotropic mixture first portion stream 20 to form stream 15 as was previously described, and azeotropic mixture stream 15 is passed to compressor 30 to complete the forecooling loop and the azeotropic mixture forecooling cycle begins anew.

As mentioned, the vaporizing azeotropic mixture serves to cool by indirect heat exchange recirculating refrigerant fluid in the main refrigeration loop as the refrigerant fluid 7 passes through heat exchanger 35. Any effective refrigerant fluid may be used in the main refrigeration loop in the practice of this invention. Examples include ammonia, R-410A, R-507A, R-134A, propane, R-23 and mixtures such as mixtures of fluorocarbons, hydrofluorocarbons, hydrochlorofluorocarbons, atmospheric gases and/or hydrocarbons.

Preferably the refrigerant fluid used in the main refrigeration loop in the practice of this invention is a multicomponent refrigerant fluid which is capable of more efficiently delivering refrigeration at different temperature levels. When such multicomponent refrigerant fluid is used it preferably comprises at least two species from the group consisting of fluorocarbons, hydrofluorocarbons, hydrochlorofluorocarbons, fluoroethers, atmospheric gases and hydrocarbons, e.g. the multicomponent refrigerant fluid could be comprised only of two fluorocarbons.

One preferred such multicomponent refrigerant preferably comprises at least one component from the group consisting of fluorocarbons, hydrofluorocarbons, and fluoroethers, and at least one component from the group consisting of fluorocarbons, hydrofluorocarbons, hydrochlorofluorocarbons, fluoroethers, atmospheric gases and hydrocarbons.

In one preferred embodiment the multicomponent refrigerant consists solely of fluorocarbons. In another embodiment the multicomponent refrigerant consists solely of fluorocarbons and hydrofluorocarbons. In another preferred embodiment the multicomponent refrigerant consists solely of fluorocarbons, fluoroethers and atmospheric gases. Most preferably every component of the multicomponent refrigerant used in the main refrigeration loop is either a fluorocarbon, hydrofluorocarbon, fluoroether or atmospheric gas.

The multicomponent refrigerant fluid useful in the main refrigeration loop in the practice of this invention may contain other components such as hydrochlorofluorocarbons and/or hydrocarbons. Preferably, the multicomponent refrigerant fluid contains no hydrochlorofluorocarbons. In another preferred embodiment of the invention the multicomponent refrigerant fluid contains no hydrocarbons. Most preferably the multicomponent refrigerant fluid contains neither hydrochlorofluorocarbons nor hydrocarbons. Most preferably the multicomponent refrigerant fluid is non-toxic, nonflammable and non-ozone-depleting and most preferably every component of the multicomponent refrigerant fluid is either fluorocarbon, hydrofluorocarbon, fluoroether or atmospheric gas. Most preferably the multicomponent refrigerant fluid is a variable load refrigerant.

Referring back now to FIG. 1, compressed refrigerant fluid 7 is passed to heat exchanger 35 wherein it is cooled by indirect heat exchange with the vaporizing azeotropic mixture recirculating in the forecooling loop as was previously described. Resulting cooled refrigerant fluid 8, which may be partially condensed, is further cooled and generally completely condensed by passage through heat exchanger 38, and resulting refrigerant fluid in stream 9 is expanded through an expansion device such as Joule-Thomson valve 39 to generate low level refrigeration.

The resulting low level refrigeration bearing refrigerant fluid is employed to cool industrial gas and also to provide cooling for the refrigerant fluid itself. Low level refrigeration bearing refrigerant fluid in stream 10 is warmed by passage through heat exchanger 40 by indirect heat exchange with industrial gas. Resulting warmed refrigerant fluid 11 is further warmed in heat exchanger 38 by indirect heat exchange with industrial gas and with cooling refrigerant fluid, and resulting further warmed refrigerant fluid 12 from heat exchanger 38 is further warmed in heat exchanger 35 by indirect heat exchange with industrial gas and with cooling refrigerant fluid. Warmed gaseous refrigerant fluid 5 from heat exchanger 35 is compressed in compressor 41 to a pressure generally within the range of from 50 to 500 psia and resulting compressed refrigerant fluid 6 is cooled of the heat of compression in cooler 42. Resulting compressed refrigerant fluid in stream 7 is passed to heat exchanger 35 and the main refrigeration loop begins anew.

Industrial gas in stream 1 is cooled by passage through heat exchanger 35 by indirect heat exchange with the aforesaid warming refrigerant fluid. Resulting cooled industrial gas 2 is further cooled by passage through heat exchanger 38 by indirect heat exchange with the aforesaid warming refrigerant fluid. Resulting further cooled industrial gas 3 is still further cooled by passage through heat exchanger 40 by indirect heat exchange with the aforesaid warming refrigerant fluid, and resulting cooled industrial gas 4 is recovered from heat exchanger 40. Generally and preferably industrial gas in stream 4 is in the liquid state.

In the embodiment of the invention illustrated in FIG. 1, the warm-end inlet process streams may be cooled to the first high level refrigeration temperature after initial throttling in a multi-stream heat exchanger using the azeotropic mixture for improved thermodynamic efficiency. The benefits of the azeotropic mixture in the high level refrigeration include leakage of uniform composition, no condensation in the intercooler, full condensation in the aftercooler, liquid entry into the heat exchanger only, no phase separators, and ease of operation and maintenance.

Figure 2:
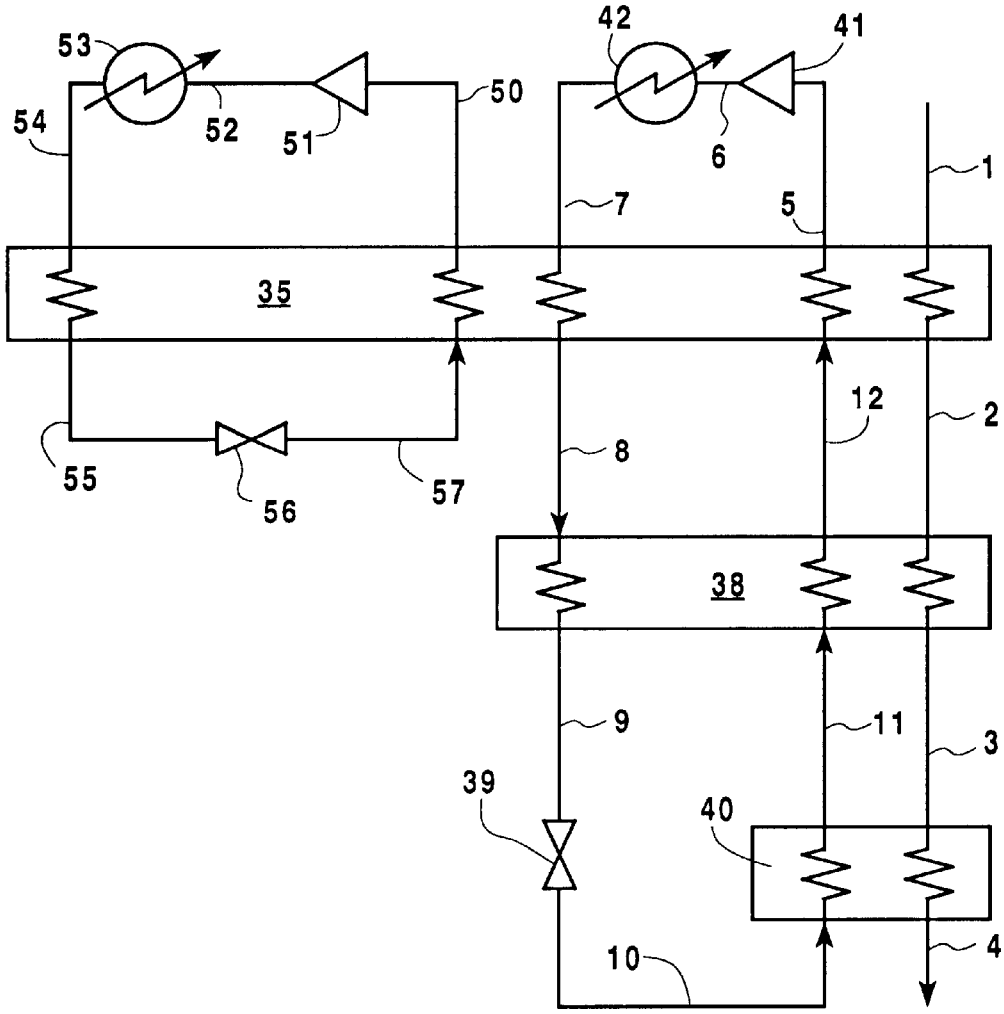
FIG. 2 is a schematic representation of another preferred arrangement wherein the industrial gas liquefaction method of this invention may be practiced.

FIG. 2 illustrates another embodiment of the invention wherein heat exchanger 32 is not employed. The numerals in FIG. 2 are the same as those in FIG. 1 for the common elements, and these common elements will not be discussed again in detail.

Referring now to FIG. 2, gaseous azeotropic mixture 50 is compressed by passage through compressor 51 to a pressure generally within the range of from 50 to 500 psia. Compressed gaseous azeotropic mixture 52 is cooled of the heat of compression in cooler 53 and resulting cooled gaseous azeotropic mixture 54 is provided to heat exchanger 35 wherein it is condensed by indirect heat exchange with vaporizing azeotropic fluid. Condensed azeotropic mixture 55 from heat exchanger 35 is expanded by passage through an expansion device such as Joule-Thomson valve 56 to generate high level refrigeration. The high level refrigeration bearing azeotropic mixture 57 is vaporized in heat exchanger 35 to effect the aforesaid condensation of azeotropic mixture in stream 54 and also to cool recirculating refrigerant fluid in the main refrigeration loop. Resulting vaporized azeotropic mixture 50 from heat exchanger 35 is passed to compressor 50 to complete the forecooling loop and the azeotropic mixture forecooling cycle begins anew.

In Table 1 there is presented the results of one example of the industrial gas liquefaction method of this invention carried out in accordance with the embodiment illustrated in FIG. 1. In the example the azeotropic mixture employed comprised 50 mass percent R-125 and 50 mass percent R-143a, the refrigerant fluid in the main refrigeration loop comprised 55 mole percent nitrogen, 33 mole percent R-14 and 12 mole percent R-218, and the industrial gas was nitrogen. This example is provided for illustrative purposes and is not intended to be limiting. The stream numbers in Table 1 correspond to those in FIG. 1.

TABLE 1

| | Forecooler | | | | | | | | | | |
|---|---|---|---|---|---|---|---|---|---|---|---|
| Stream | 13 | 14 | 15 | 16 | 17 | 18 | 19 | 20 | 21 | 22 | 23 |
| P, psia | 19.5 | 40.7 | 40.7 | 207.7 | 205.7 | 204.7 | 41.7 | 40.7 | 204.7 | 202.7 | 21.2 |
| T, K | 288.9 | — | — | 366.5 | 298.0 | 259.7 | 250.6 | 288.0 | 259.6 | 229.3 | 229.8 |
| F, lbmole/hr | 4.1 | 4.1 | 5.6 | 5.6 | 5.6 | 5.6 | 1.44 | 1.44 | 4.1 | 4.1 | 4.1 |
| Vapor Frac. | 1 | 1 | 1 | 1 | 1 | 0.0 | 0.07 | 1.0 | 0.0 | 0.0 | 0.0 |

| | Main Loop | | | | | | | |
|---|---|---|---|---|---|---|---|---|
| Stream | 5 | 6 | 7 | 8 | 9 | 10 | 11 | 12 |
| P, psia | 29.3 | 283.7 | 272.7 | 271.7 | 270.7 | 37.7 | 33.3 | 31.3 |
| T, K | 281.7 | 351.1 | 305.1 | 230.0 | 100.0 | 90.6 | 90.1 | 218.0 |
| F, lbmole/hr | 30.8 | 30.8 | 30.8 | 30.8 | 30.8 | 30.8 | 30.8 | 30.8 |
| Vapor Frac. | 1.0 | 1.0 | 1.0 | 0.898 | 0.0 | 0.136 | 0.233 | 1.0 |

| | Industrial Gas | | | |
|---|---|---|---|---|
| Stream | 1 | 2 | 3 | 4 |
| P, psia | 70.5 | 69.5 | 69.0 | 69.0 |
| T, K | 281.5 | 230.0 | 93.4 | 93.4 |

TABLE 1-continued

| | | | | |
|---|---|---|---|---|
| F, lbmole/hr | 5.25 | 5.25 | 5.25 | 5.25 |
| Vapor Frac. | 1.0 | 1.0 | 0.5 | 0.0 |

Although the invention has been described in detail with reference to certain preferred embodiments, those skilled in the art will recognize that there are other embodiments within the spirit and the scope of the claims. For example, additional refrigeration loops, in addition to the azeotropic mixture forecooling loop and the main refrigeration loop, may be employed.

What is claimed is:

1. A method for cooling industrial gas comprising:

(A) compressing a gaseous azeotropic mixture, and condensing the compressed azeotropic mixture;

(B) expanding a first portion of the condensed azeotropic mixture to generate refrigeration, and vaporizing the refrigeration bearing azeotropic mixture first portion by indirect heat exchange with the compressed azeotropic mixture to effect the said condensation of the compressed azeotropic mixture;

(C) subcooling a second portion of the condensed azeotropic mixture and expanding the subcooled azeotropic mixture second portion to generate high level refrigeration;

(D) vaporizing the high level refrigeration bearing azeotropic mixture second portion by indirect heat exchange with compressed refrigerant fluid to provide cooled, compressed refrigerant fluid;

(E) expanding the cooled compressed refrigerant fluid to generate low level refrigeration; and (F) warming the low level refrigeration bearing refrigerant fluid by indirect heat exchange with industrial gas to cool the industrial gas.

2. The method of claim 1 wherein the azeotropic mixture comprises R-125 and R-143a.

3. The method of claim 1 wherein the azeotropic mixture comprises at least two components from the group of R-134a, R-32, R-290, R-143a, R-125, R-23, R-116, R-744, R-347E, R-123, R-4112, methanol, and ethanol.

4. The method of claim 1 wherein the azeotropic mixture is a binary mixture.

5. The method of claim 1 wherein the high level refrigeration temperature is less than 260 K and the low level refrigeration temperature is less than 240 K.

6. A method for cooling industrial gas comprising:

(A) compressing a gaseous azeotropic mixture, condensing the compressed azeotropic mixture, and expanding the compressed condensed azeotropic mixture to generate high level refrigeration;

(B) vaporizing the high level refrigeration bearing azeotropic mixture by indirect heat exchange with compressed refrigerant fluid to provide cooled compressed refrigerant fluid;

(C) expanding the cooled compressed refrigerant fluid to generate low level refrigeration; and (D) warming the low level refrigeration bearing refrigerant fluid by indirect heat exchange with industrial gas to cool the industrial gas.

7. The method of claim 6 wherein the azeotropic mixture comprises R-125 and R-143a.

8. The method of claim 6 wherein the azeotropic mixture comprises at least two components from the group of R-134a, R-32, R-290, R-143a, R-125, R-23, R-116, R-744, R-347E, R-123, R-4112, methanol, and ethanol.

9. The method of claim 6 wherein the azeotropic mixture is a binary mixture.

10. The method of claim 6 wherein the high level refrigeration temperature is less than 260 K and the low level refrigeration temperature is less than 240 K.

* * * * *